US008260179B2

(12) United States Patent
Miura et al.

(10) Patent No.: US 8,260,179 B2
(45) Date of Patent: Sep. 4, 2012

(54) IMAGE FORMING APPARATUS INCLUDING FIRST AND SECOND IMAGE FORMING DEVICES AND FIRST AND SECOND BELT UNITS

(75) Inventors: Yohei Miura, Machida (JP); Kouji Amanai, Yokohama (JP); Joh Ebara, Kamakura (JP); Toshiyuki Uchida, Kawasaki (JP); Narumi Sugita, Minamiashigara (JP); Keisuke Sugiyama, Yokohama (JP); Kenji Tomita, Kawasaki (JP); Kimiharu Yamazaki, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 209 days.

(21) Appl. No.: 12/791,554

(22) Filed: Jun. 1, 2010

(65) Prior Publication Data

US 2010/0310281 A1 Dec. 9, 2010

(30) Foreign Application Priority Data

Jun. 3, 2009 (JP) ..... 2009-133931

(51) Int. Cl.
*G03G 15/01* (2006.01)

(52) U.S. Cl. ..... 399/298

(58) Field of Classification Search ..... 399/298, 399/299, 302

See application file for complete search history.

(56) References Cited

U.S. PATENT DOCUMENTS

| | | | |
|---|---|---|---|
| 6,889,022 | B2 | 5/2005 | Ehara et al. |
| 6,949,896 | B2 | 9/2005 | Andoh et al. |
| 7,050,738 | B2 | 5/2006 | Amanai |
| 7,110,700 | B2 | 9/2006 | Andoh et al. |
| 7,206,537 | B2 | 4/2007 | Funamoto et al. |
| 7,242,883 | B2 | 7/2007 | Miura |
| 7,245,862 | B2 | 7/2007 | Ebara |
| 7,251,444 | B2 | 7/2007 | Matsuda et al. |
| 7,257,339 | B2 | 8/2007 | Yokoyama et al. |
| 7,330,009 | B2 | 2/2008 | Andoh et al. |
| 7,352,978 | B2 | 4/2008 | Ebara et al. |

(Continued)

FOREIGN PATENT DOCUMENTS

JP 06167842 A * 6/1994

(Continued)

OTHER PUBLICATIONS

Search Report issued Sep. 20, 2010, in European Patent Application No. 10164277.5-2209.

*Primary Examiner* — Quana M Grainger
(74) *Attorney, Agent, or Firm* — Oblon, Spivak, McClelland, Maier & Neustadt, L.L.P.

(57) ABSTRACT

An image forming apparatus includes a primary transfer device that primarily transfers a first image from a first image bearer onto a first belt unit at a primary transfer position, a secondary transfer device that secondarily transfers the first image from the first belt unit onto a printing medium at a secondary transfer position, and a direct transfer device that directly transfers a second image from a second image bearer onto the printing medium at a direct transfer position. A second belt unit is rotatably suspended by plural second rollers and carries and conveys the printing medium through the direct transfer position and the secondary transfer position. An interval between the direct transfer position and the secondary transfer position is prescribed natural number times of a circumference of one of the plural second rollers, which fluctuates a velocity of the second belt unit.

16 Claims, 9 Drawing Sheets

U.S. PATENT DOCUMENTS

| | | | | |
|---|---|---|---|---|
| 7,369,795 | B2 | 5/2008 | Funamoto et al. | |
| 7,373,093 | B2 | 5/2008 | Shinohara et al. | |
| 7,376,375 | B2 | 5/2008 | Kobayashi et al. | |
| 7,376,376 | B2 | 5/2008 | Ebara et al. | |
| 7,386,262 | B2 | 6/2008 | Okamura et al. | |
| 7,454,150 | B2 | 11/2008 | Matsuda et al. | |
| 7,460,820 | B2 * | 12/2008 | Okabe | 399/301 |
| 7,509,074 | B2 | 3/2009 | Yokoyama et al. | |
| 7,532,842 | B2 | 5/2009 | Handa et al. | |
| 7,587,157 | B2 | 9/2009 | Matsuda et al. | |
| 7,603,061 | B2 | 10/2009 | Ebara et al. | |
| 7,630,657 | B2 | 12/2009 | Ehara et al. | |
| 7,653,332 | B2 | 1/2010 | Ehara et al. | |
| 7,693,468 | B2 | 4/2010 | Ehara et al. | |
| 7,697,867 | B2 | 4/2010 | Ehara et al. | |
| 7,729,024 | B2 | 6/2010 | Kobayashi et al. | |
| 2003/0129006 | A1 | 7/2003 | Hoshi et al. | |
| 2006/0133873 | A1 | 6/2006 | Andoh et al. | |
| 2007/0122172 | A1 | 5/2007 | Ebara et al. | |
| 2007/0140736 | A1 | 6/2007 | Ehara et al. | |
| 2007/0166075 | A1 | 7/2007 | Funamoto et al. | |
| 2007/0189815 | A1 | 8/2007 | Andoh et al. | |
| 2007/0196132 | A1 | 8/2007 | Kobayashi et al. | |
| 2008/0069604 | A1 | 3/2008 | Ebara et al. | |
| 2008/0131168 | A1 | 6/2008 | Ehara et al. | |
| 2008/0211176 | A1 | 9/2008 | Miura et al. | |
| 2008/0213000 | A1 | 9/2008 | Funamoto et al. | |
| 2008/0240754 | A1 | 10/2008 | Kobayashi et al. | |
| 2009/0003877 | A1 | 1/2009 | Miura | |
| 2009/0017953 | A1 | 1/2009 | Uehara et al. | |
| 2009/0074506 | A1 | 3/2009 | Sugiyama et al. | |
| 2009/0123183 | A1 | 5/2009 | Sugiyama | |
| 2009/0169225 | A1 | 7/2009 | Murata et al. | |
| 2009/0169259 | A1 | 7/2009 | Ebara et al. | |
| 2009/0263158 | A1 | 10/2009 | Murata et al. | |

FOREIGN PATENT DOCUMENTS

| | | |
|---|---|---|
| JP | 2008-90092 | 4/2008 |
| JP | 2009-198899 | 9/2009 |

* cited by examiner

IMAGE FORMING APPARATUS INCLUDING FIRST AND SECOND IMAGE FORMING DEVICES AND FIRST AND SECOND BELT UNITS

CROSS-REFERENCE TO RELATED APPLICATIONS

This application claims priority under 35 USC §119 to Japanese Patent Application No. 2009-133931, filed on Jun. 3, 2009, the entire contents of which are herein incorporated by reference.

BACKGROUND OF THE INVENTION

1. Field of the Invention

The present invention relates to an image forming apparatus, such as a printer, a facsimile, a copier, etc.

2. Discussion of the Background Art

Conventionally, a color image forming apparatus that includes plural image formation sections for forming color images of component colors including black is known.

As described in the Japanese Patent Application Laid Open No. 2006-201743, there are provided, in an image forming apparatus, a direct transfer position where a black color image formed in a black image formation section is directly transferred and a secondary transfer position where the other color images primary transferred onto an intermediate transfer belt from the image formation sections for the other colors is secondarily transferred. The secondary transfer position is located upstream of the direct transfer position. The intermediate transfer belt is rotatably suspended by plural rollers and driven by a driving roller among the plural rollers. Further, another belt is provided and is rotatably suspended by plural rollers to carry and convey a printing sheet through the direct and secondary transfer positions. Specifically, the other color images transferred onto the printing sheet at the secondary transfer position are superimposed on the black image at the direct transfer position, whereby a full color image is formed. Carrying and conveying the printing sheet with the belt eliminates deviation in a printing sheet conveyance path extending between the direct and secondary transfer positions, whereby the printing sheet can be stably conveyed therebweteen.

However, intracyclical fluctuation in rotational velocity of the rollers which rotatably suspend the belt does occur, due to either eccentricity or a change of load thereon or the like. Accordingly, the rotational velocity of the belt similarly fluctuates in the same cycle. Since a printing sheet is carried and conveyed by the belt, and the conveyance velocity of the printing sheet similarly varies in accordance with the rotational velocity of the belt and the roller when a phase of the velocity fluctuation of the printing sheet differs between the direct and secondary transfer positions, positional deviation occurs between the location of black image and the images formed with the other colors at the direct and secondary transfer positions.

A system excluding the belt can be provided, in which a roller is employed instead of the belt and opposes the drive roller via the intermediate transfer belt to pinch a printing sheet therebetween. Specifically, the roller applies conveyance force and conveys the printing sheet through the secondary transfer and direct transfer positions.

However, the conveyance velocity of the printing sheet fluctuates with a rotation cycle of the roller 13. Thus, when the velocity fluctuates and a phase thereof is different between the direct and secondary transfer positions, displacement of the black from the other colors and vice verse occurs on the printing sheet transferred at these positions in a rotation cycle of the roller.

SUMMARY OF THE INVENTION

Accordingly, an object of the present invention is to address and resolve such and other problems and provide a new and novel image forming apparatus. Such a new and novel mage forming apparatus includes a primary transfer device that primarily transfers a first image from a first image bearer onto a first belt unit at a primary transfer position, a secondary transfer device that secondarily transfers the first image from the first belt unit onto a printing medium at a secondary transfer position, and a direct transfer device that directly transfers a second image from a second image bearer onto the printing medium at a direct transfer position.

A second belt unit is rotatably suspended by plural second rollers and carries and conveys the printing medium through the direct transfer position and the secondary transfer position. An interval between the direct transfer position and the secondary transfer position is a prescribed natural number times a circumference of one of the plural second rollers, which causes a velocity of the second belt unit to fluctuate.

In another aspect, the below-described formula is established, $$x=2\pi r1\cdot n1;$$

wherein x represents the interval between the direct transfer and secondary transfer positions, r1 represents a radius of one of the at least two second rollers, one of the at least two second rollers driving and rotating the at least one second belt unit, and n1 represents the prescribed natural number.

In another aspect, the below-described formula is established, $$y=2\pi r2\cdot n2;$$

wherein y represents an interval between the primary transfer position and the secondary transfer position in the first belt unit rotating direction, r2 represents a radius of one of the at least two first rollers, one of the at least two first rollers driving and rotating the first belt unit, and n2 represents the prescribed natural number.

In another aspect, the below-described formula is established;

$$z=2\pi r2\cdot n3,$$

wherein z represents an interval between neighboring two primary transfer positions of the at least two first image bearers, r2 represents a radius of one of the at least two first rollers, one of the at least two first rollers driving and rotating the first belt unit, and n3 represents the prescribed natural number.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

PREFERRED EMBODIMENTS OF THE PRESENT INVENTION

Figure 1:
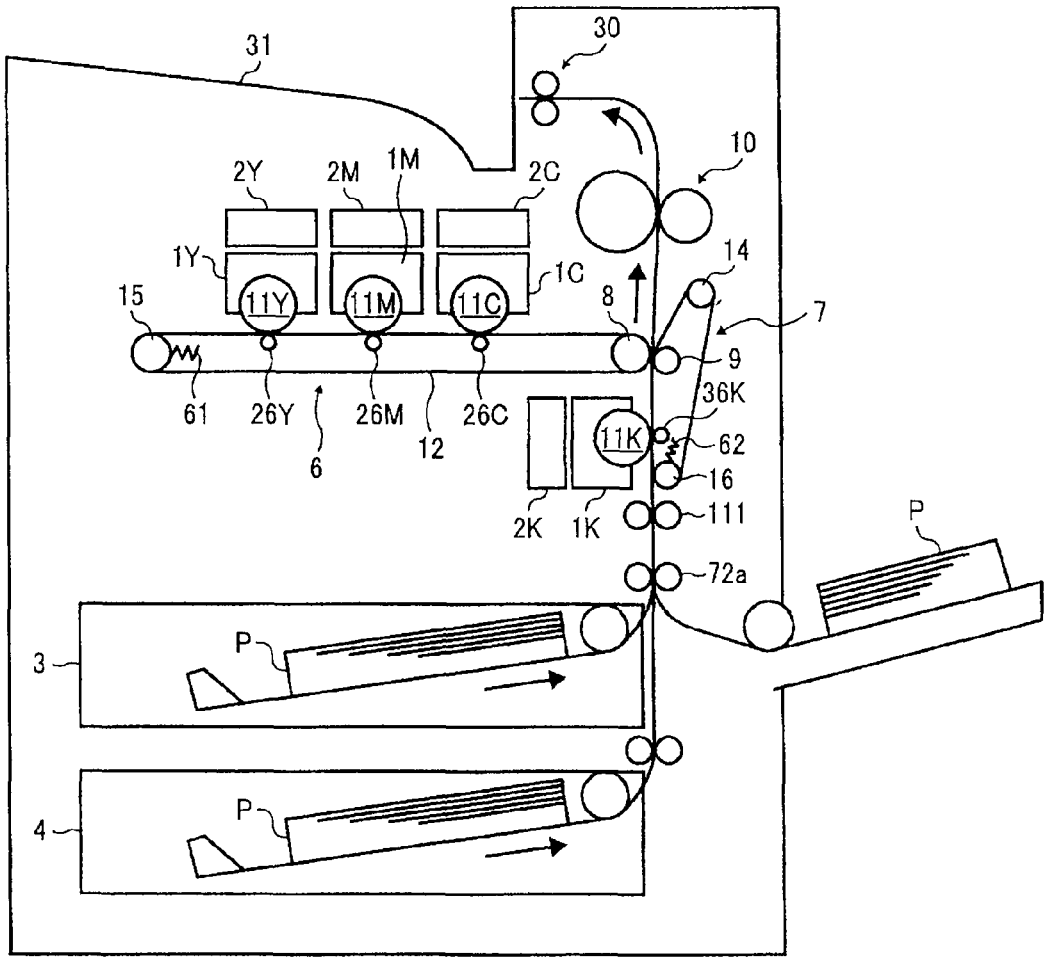
FIG. 1 illustrates an exemplary printer according to one embodiment of the present invention.

Referring now to the drawing, wherein like reference numerals designate identical or corresponding parts throughout several views, in particular, in FIG. 1, a fist embodiment is described. As shown, a color laser printer (hereinafter simply referred to as a printer) as an image forming apparatus employs an electro-photographic system. The printer includes a printing section.

The printing section includes four image formation units for forming respective toner images of yellow, magenta, cyan, and black (herein after simply referred to as Y, M, C, and K) 1Y to 1K. An intermediate transfer unit 6 included in a printing section includes a drive roller 8 arranged inside a belt loop, a tension roller 15, and an intermediate transfer belt 12 suspended by three primary transfer rollers 26Y to 26K horizontally extending. The tension roller 15 is movably supported by a shaft and receives a bias from a spring 61 and provides a tension to the intermediate transfer belt 12 from it inside to outside. The intermediate transfer belt 12 serves as an image bearer and is endlessly moved counter clockwise by an operation of the drive roller 8. Three image formation units 1Y to 1C are aligned along the suspension plane of the intermediate transfer belt 12.

The image formation units 1Y to 1K support drum state photo-conductive members 11Y to 11K, charge devices, developing devices, and drum cleaning devices with holders, respectively, and are integrally detached from a casing of the printing section. The above-mentioned charge devices uniformly charge circumference of the photoconductive members 11Y to 11K in a dark with charge polarity opposite to that of toner, respectively.

Above the image formation units 1Y to 1C and on the left side of image formation unit 1K, there are arranged optical writing units 2Y to 2K. Color image information transmitted from a personal computer externally arranged, not shown, is resolved into Y to K information in an image processing system, not shown, and is processed in the printing section. The optical writing units 2 drive light sources for Y to K use, not shown, and generate optical writing lights for Y to K use using a conventional technology. Then, the circumference of the photoconductive members 11Y to 11K with the uniform charges are scanned by the Y to K use optical writing lights, respectively. Thus, latent images are formed on the circumference surfaces of the 4 photoconductive members 11Y to 11K for Y to K use, respectively. As a light source of the writing light, a LD and an LED or the like can be exemplified.

These latent images on the circumference surfaces are developed by developing devices that employ well known two component developing systems each using two component developer having toner and carrier to be Y to K toner images, respectively. One component developing system that employs one component developer having toner can be used as the developing device.

Only Y to C use photoconductive members 11Y to 11C contact the intermediate transfer belt 12 and form primary transfer nips for Y to C uses, respectively. Further, inside the loop of the intermediate transfer belt 12, there are arranged primary transfer rollers 26Y to 26C for depressing the intermediate transfer belt 12 to the Y to C use photoconductive members 11Y to 11C, respectively. To the primary transfer rollers 26Y to 26C, primary transfer biases are applied, and create transfer electric fields in Y to C use primary transfer nips, respectively. The toner images of Y to C on the circumference of the photo-conductive members 11Y to 11C are transferred and superimposed at respective Y to C use primary transfer nips on the front surface of the intermediate transfer belt 12 (i.e., outside surface of the loop) under influence of the transfer electric fields and nip pressure. Thus, triple color superimposed toner image is formed on the front surface of the intermediate transfer belt 12.

On the right side of the intermediate transfer belt 12, there is arranged a direct transfer unit 7 including an endless direct transfer belt 13. The direct transfer belt 13 is suspended longitudinally by the secondary transfer roller 9, a drive roller 14, a tension roller 16, and a K use transfer roller 36K, and endlessly moved clockwise by an operation of the drive roller 14. The tension roller 16 is movably supported by a shaft and receives a bias from a spring 62 and provides a tension to the direct intermediate transfer belt 12 from it inside to outside. A secondary transfer nip is formed by engaging a section of the direct transfer belt 13 on the secondary transfer roller 9 with a section of the intermediate transfer belt 12 on the drive roller 8. A secondary transfer bias is applied to the secondary transfer roller 9, whereby a transfer electric field is formed within the secondary transfer nip. Further, a direct transfer nip for K use is also formed by engaging a section of the direct transfer belt 13 with the K use photoconductive member 11K. A primary transfer bias is also applied to the transfer roller 36K similar to the primary transfer rollers 26Y to 26C, whereby a transfer electric field is formed in the K use direct transfer nip.

In the lower section of the casing of the printing section, there are vertically arranged first and second sheet feeding cassettes 3 and 4. These sheet-feeding cassettes 3 and 4 accommodate and launch printing sheets P onto a sheet conveyance path. The printing sheet P then collides with a registration roller pair 111 arranged on a sheet conveyance path vertically extending in the printing section and its skew is corrected. Them, the printing sheet P is further conveyed upward at a prescribed time by the registration roller pair 111.

The printing sheet P launched from the registration roller pair 111 passes through the above-mentioned K use direct transfer and respective Y to C use secondary transfer nips one by one. When the printing sheet P passes through the K use direct transfer nip, the K-toner image on the circumference of the photo-conductive member 11K receives influence of both of the transfer electric field and the nip pressure and is transferred onto the printing sheet P. Further, when the printing sheet P passes through the secondary transfer nip, triple color superimposed toner images of Y to C on the intermediate transfer belt 12 are transferred at once onto the K-toner image on the printing sheet P under influence of both of a transfer electric field and a nip pressure during secondary transfer. Thus, four color superimposed toner images of Y to K are formed on the surface of the printing sheet P as a full color image.

The toner sticking to the surface of the photo-conductive members 11Y to 11K passing through the primary transfer nips for Y to C use and the direct transfer nip for K use are removed by a drum cleaning device. As the drum-cleaning device for the Y to K use, a cleaning blade, a fur brush roller, or a magnetic brush cleaning is used.

Above the secondary transfer nip, there is arranged a fixing device 10 including a heating roller and a pressing roller contacting each other creating a nip therebetween. The printing sheet P passing through the secondary transfer nip is conveyed to a fixing nip in the fixing device 10 to be subjected to a fixing process for fixing a full color image onto a printing sheet P by heat and pressure. Then, the printing sheet P is ejected and stacked on a sheet ejection tray 31 arranged on the upper surface of the casing of the printing section via a sheet ejection roller pair 30.

In a monochrome mode of this printer forming a monochrome image, an external personal computer, not shown, transmits monochrome image data to an optical writing unit 2K. Then, the optical writing unit 2K applies optical scanning to the K use photoconductive member in accordance with the monochrome image data, whereby a K use latent image is formed thereon and developed by the developing device into a black toner image. The black toner image is directly transferred onto the printing sheet P in the direct transfer nip for K use, and is fixed onto the printing sheet P in the fixing device 10.

Specifically, in the monochrome mode, the secondary transfer roller 9 arranged within the loop of the direct transfer belt 13 is moved far from the intermediate transfer belt 12, whereby the direct transfer belt 13 is separated from the intermediate transfer belt 12. When forming a monochrome image, image formation units 1Y to 1C for Y to C uses or the intermediate transfer belt 12 is not driven, ablation of those devices generally caused by their needless driving can be avoided and their lives are prolonged.

Otherwise, the drive roller 8 supporting the intermediate transfer belt 12 can be displaced by a device, not shown, to separate the intermediate transfer belt 12 from the direct transfer belt 13. In this situation, since the conveyance posture of the printing sheet P is not changed, behavior of the printing sheet P can be stable between the direct transfer belt 13 and the fixing device 10. Thus, the printing sheet P ejected from the fixing device 10 can avoid wrinkle and disturbance of an image thereon.

Since the image formation unit 1K directly transfers a K toner image onto a printing sheet P conveyed to the direct transfer nip from the registration roller pair 111 in the monochrome mode, printing can be faster than that in a system in which the K toner image is transferred onto the printing sheet P at the secondary transfer nip from the intermediate transfer belt 12.

Figure 2:
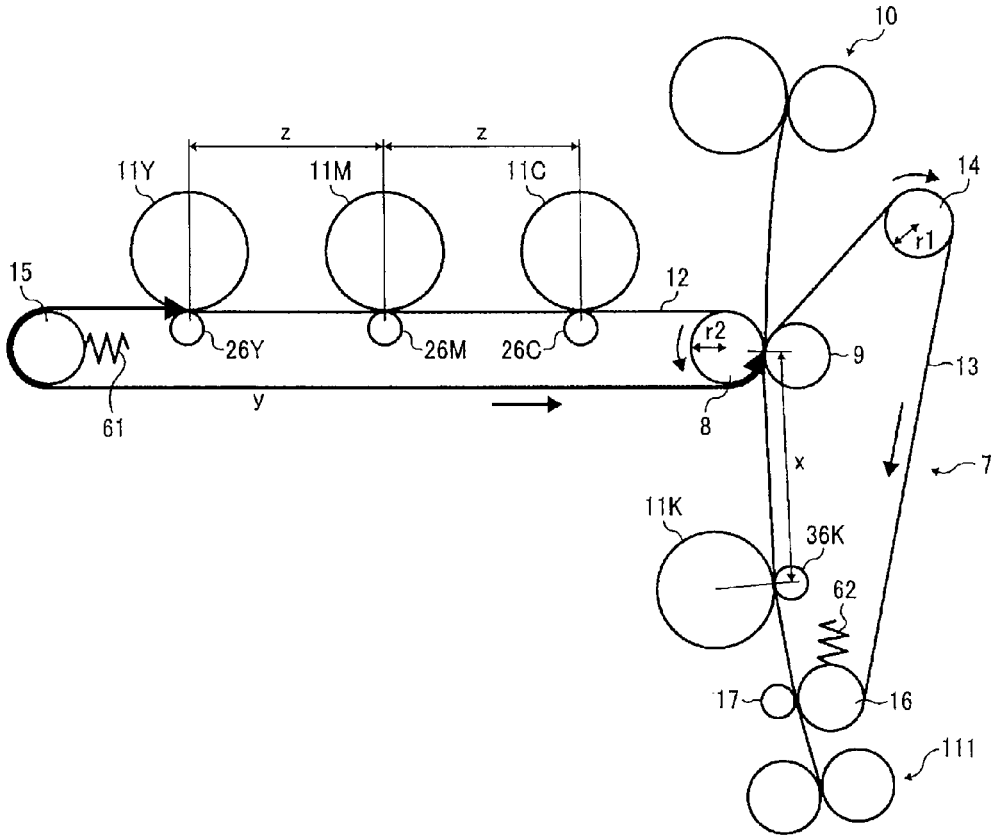
FIG. 2 illustrates an exemplary transfer section as a feature of the first embodiment of the present invention.

An exemplary transfer section as a feature of this embodiment is described more in detail with reference to FIG. 2. As described above, the intermediate transfer belt 12 is suspended by the drive and tension rollers 8 and 15. The direct transfer belt 13 is suspended by the secondary transfer roller 9, and the drive and tension rollers 14 and 16. The drive roller 14 is driven rotated by a drive motor, not shown, provided in the printer body. The tension roller 16 is driven rotated by the direct transfer belt 13 driven rotated by the drive roller 14. A sheet absorption roller 17 is arranged opposing to the tension roller 16 via the direct transfer belt 13 to electrostatically sticks the printing sheet P onto the direct transfer belt 13 while receiving a prescribed voltage from a power source, not shown. The sheet absorption roller 17 contacts the front surface of the direct transfer belt 13 (i.e., an external loop surface) and is driven as the direct transfer belt 13 rotates.

The printer is configured to meet the following formulas, wherein r1 represents the radius of the drive roller 14, r2 represents the radius of the drive roller 8, x represents a distance from the K-use direct transfer nip to the secondary transfer nip, y represents a distance from the Y-use primary transfer nip to the secondary transfer nip along the downstream of the intermediate transfer belt, and z represents the distance between the C-use and M-use primary transfer nips or that between the M-use and Y-use primary transfer nips, i.e., a station pitch between neighboring image formation units 1Y to 1C, and wherein, n1, n2, and n3 represent natural numbers of one, five, and one (i.e., n1=1, n2=5, and n3=1), respectively, in the formulas 1 to 3 of this embodiment; Further, distances between respective nips are measured between their nip centers.

$$x=2\pi r1\cdot n1 \quad \text{(Formula 1)}$$

$$y=2\pi r2\cdot n2 \quad \text{(Formula 2)}$$

$$z=2\pi r2\cdot n3 \quad \text{(Formula 3)}$$

The conveyance velocity of the intermediate transfer belt 12 fluctuates in one rotation cycle of the driving roller 8 that drives and rotates the intermediate transfer belt 12 due to its eccentricity or the like. Specifically, the velocity fluctuates in a cycle of $2\pi r^2/V0$, wherein V0 represents a target velocity of the intermediate transfer belt 12. Thus, toner images transferred from the photoconductive members 11Y to 11C onto the intermediate transfer belt 12 in the primary transfer process displaces from each other in one cycle of the driving roller 8.

Figure 3:
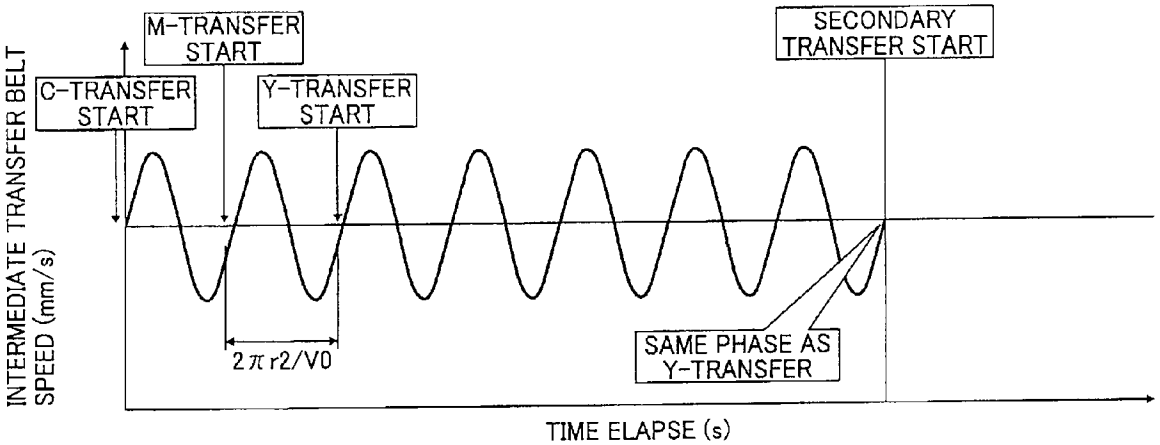
FIG. 3 graphically illustrates an exemplary positional relation between primary transfer nips for Y, M, and C color uses and a cycle of velocity fluctuation of the intermediate transfer belt.

Whereas as represented by the above-mentioned formula 3 of this embodiment, since the station pitch z corresponds to a circumference (i.e., one rotation pitch) of the driving roller 8, respective primary nips for Y to C always serve image positions at the same phase as shown in FIG. 3. Thus, color deviation of the Y to C toner images can be suppressed when primarily transferred onto the intermediate transfer belt 12 in the primary transfer process.

The intermediate transfer belt 12 sequentially receiving the C to Y toner images at the respective primary transfer nips for C to Y uses is further driven rotated with its velocity fluctuating in one rotation cycle of the driving roller 8, and conveys the triple color supervision image from the Y use primary to secondary transfer nips.

When the velocity of the intermediate transfer belt 12 in the Y use primary transfer nip is different from that in the secondary transfer nip, the triple color supervision image transferred from the intermediate transfer belt 12 onto the printing sheet P in the secondary transfer nip does not include color deviation but shrinks on the printing sheet P.

Whereas in this embodiment, as shown by formula 2, the distance y is the natural number times of the circumference of the driving roller 8. Thus, since the velocity in the Y use primary and secondary transfer nips fluctuate at the same phase with each other, the above-mentioned image shrinkage can be suppressed.

Further, the printing sheet P entering the nip formed between the tension roller 16 and the sheet absorption roller 17 via the intermediate transfer belt 13 is absorbed and is conveyed by the direct transfer belt 13. Thus, velocity of the printing sheet P similarly fluctuates as the direct transfer belt 13. Specifically, the velocity of the printing sheet P fluctuates in one rotation cycle of the driving roller 14 that drives and rotates the direct transfer belt 13 after the printing sheet P enters the nip. Thus, when such fluctuation is included in the conveyance velocity of the printing sheet P, velocity of the direct transfer process for the black toner image in the K-use direct transfer nip is different from that in the secondary transfer process for Y to C toner superimposed image at the secondary transfer nips. Thus, color deviation of the Y to K toner images likely occurs in one rotation cycle of the driving roller 14 on the printing sheet P when transferred.

Figure 4:
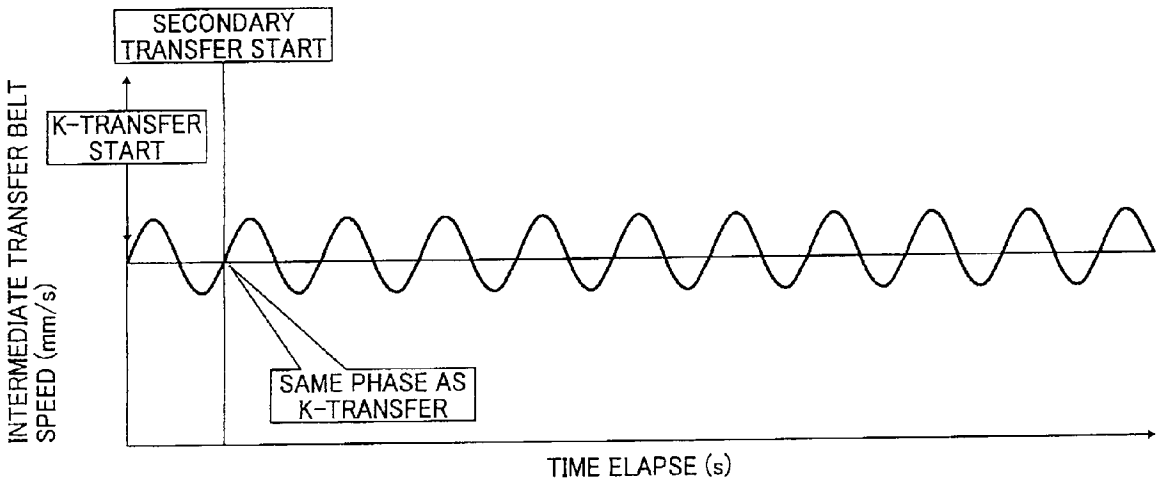
FIG. 4 graphically illustrates an exemplary relation between phases of velocity fluctuations caused in the direct transfer belt when direct and secondary transfer operations are executed.

Whereas in this embodiment, as represented by formula 1, the distance between the K use direct and secondary transfer nips corresponds to the circumference of the driving roller 14 (i.e., one rotation pitch). Thus, since the phase of the velocity fluctuation of the direct transfer belt 13 in the secondary transfer nip can be equalized with that of the direct transfer belt 13 in the direct transfer nip, the conveyance velocity of the printing sheet P is the same both of when the K toner image is directly transferred at the K-use direct transfer nip and when the toner images of Y to C are transferred at the secondary transfer nips as secondary transfer processes as shown in FIG. 4. Accordingly, color deviation of the Y to K toner images in one rotation cycle of the driving roller 14 likely occurring on the printing sheet P when transferred can be suppressed.

Thus, the velocity fluctuation of the driving roller 8 in one rotation cycle thereof dominantly affects the conveyance velocity of the intermediate transfer belt 12. However, the conveyance velocity of the direct belt 13 can also be induced in one rotation cycle (i.e., one rotation pitch) of either the tension roller 15 driven rotated by the intermediate transfer belt 12 or each of the primary transfer rollers 26Y to 26C when they have eccentricity or load variation.

Further, the velocity fluctuation of the driving roller 14 in one rotation cycle dominantly affects the conveyance velocity of the direct transfer belt 13. However, the conveyance velocity of the direct transfer belt 13 can also fluctuate in one rotation cycle (i.e., one rotation pitch) of one of the secondary transfer roller 9, the tension roller 16, and the sheet absorption roller 17 each driven rotated by the direct transfer belt 13 based on load variation or the like.

However, when the below described formulas 4 to 6 are established, color deviation and image shrinkage likely caused in a pitch of the driven rollers (i.e., one rotation cycle of the driven roller) can be suppressed, wherein r3 represent a radius of the driven roller (e.g. the transfer roller 36K, the secondary transfer roller 9, the tension roller 16, or the sheet absorption roller 17), and r4 represents a radius of the driven roller (e.g. the primary transfer rollers 26Y to 26CK, or the tension roller 157).

$$x=2\pi r3\cdot n4 \quad \text{(Formula 4)}$$

$$y=2\pi r4\cdot n5 \quad \text{(Formula 5)}$$

$$z=2\pi r4\cdot n6 \quad \text{(Formula 6)}$$

Figure 5:
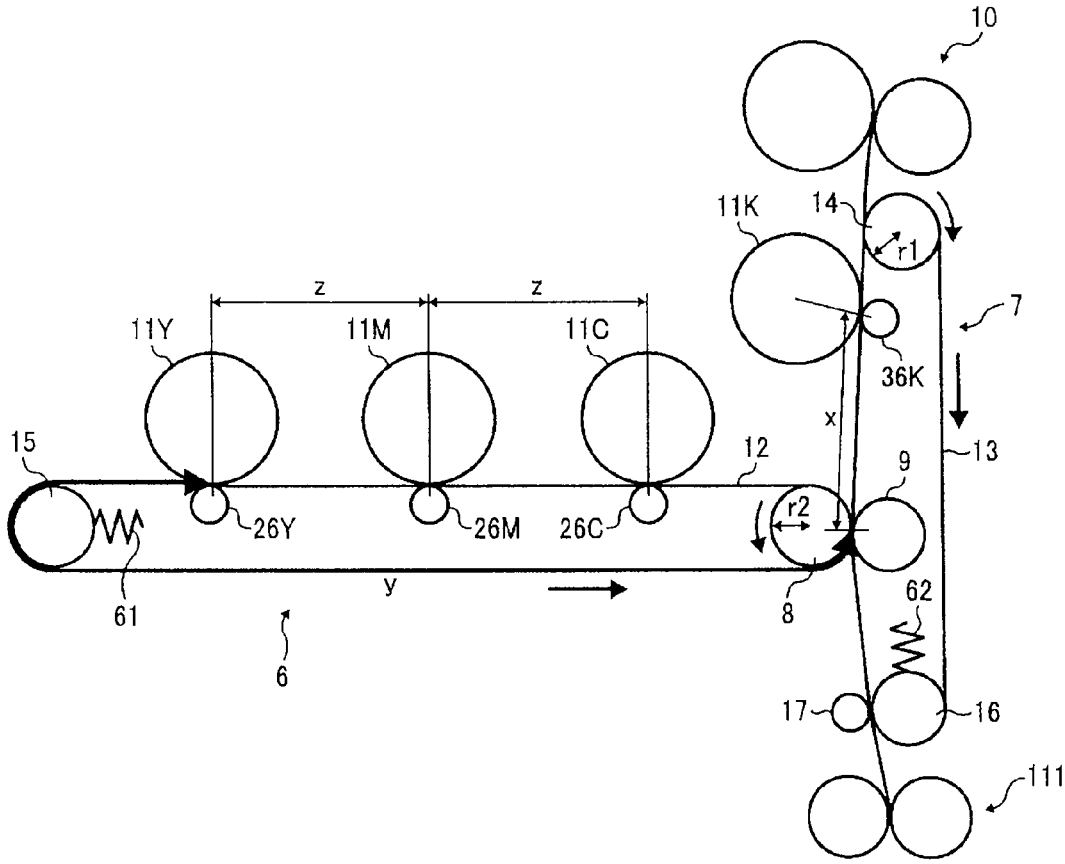
FIG. 5 schematically illustrates an exemplary transfer section when an image formation unit for black use is arranged downstream of a secondary transfer nip.
Figure 6:
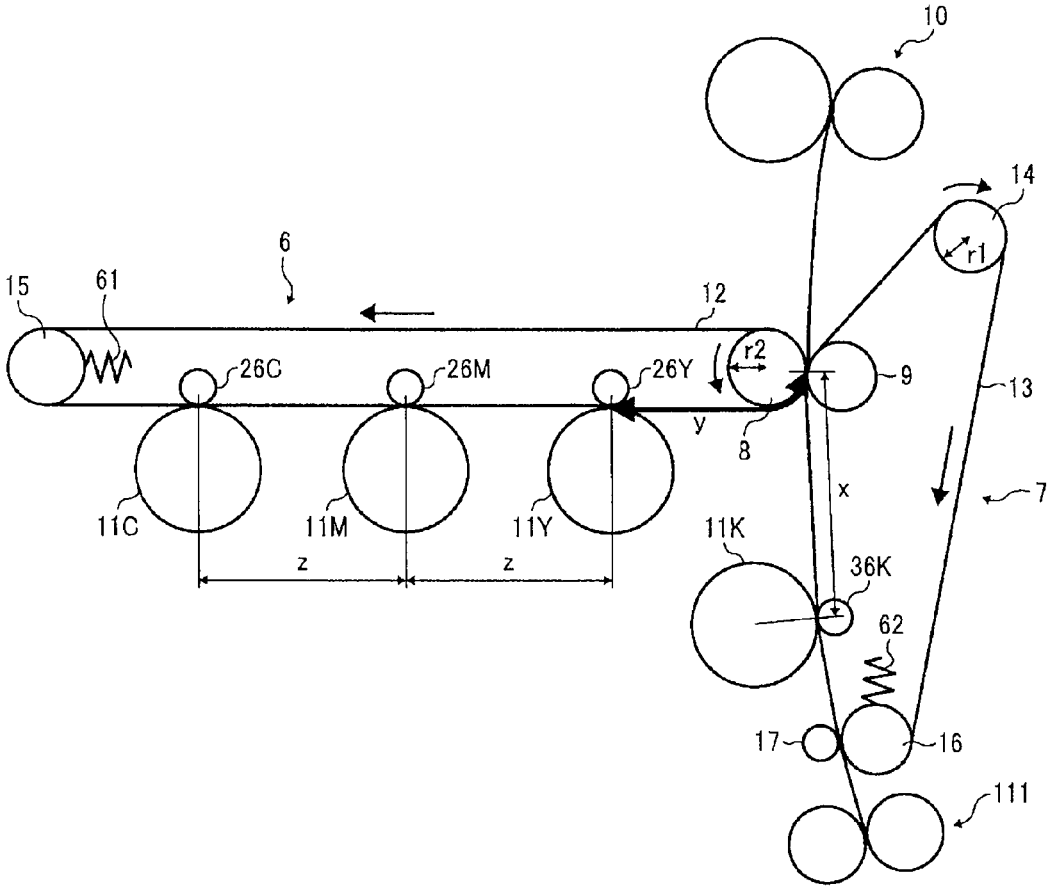
FIG. 6 schematically illustrates an exemplary transfer section when photoconductive members are arranged below the intermediate transfer belt.

The all of configurations meeting the formulas 1 to 6 has independent dynamic relation from the other in the intermediate transfer unit 6 and the direct transfer unit 7. Accordingly, as shown in FIG. 5, even if the K use image formation unit 1K (i.e., the K use direct transfer nip) is arranged downstream of the secondary transfer nip, the above-mentioned color deviation and the image shrinkage can similarly be suppressed.

Further, in this embodiment, the intermediate transfer belt 12 and the direct transfer belt 13 contact each other at the secondary transfer nip rotating in the different direction from the other. However, due to influence of (coefficient of) dynamic friction of the belt or a secondary transfer pressure, a velocity of the intermediate transfer belt 12 fluctuates in one cycle of the driving roller 14 via the direct transfer belt 13. To the contrary, a velocity of the direct transfer belt 13 fluctuates in one cycle of the driving roller 8 via the intermediate transfer belt 12.

When a velocity of the intermediate transfer belt 12 fluctuates in one rotation cycle of the driving roller 14, the toner images of Y to C sometimes displace each other in one rotation cycle of the driving roller 14 when transferred from the photo-conductive members 11Y to 11C onto the intermediate transfer belt 12 in the primary transfer process. Otherwise, the composed image shrinks when transferred onto the printing sheet P in the secondary transfer process. When the velocity of the direct transfer belt 13 fluctuates in one rotation cycle of the driving roller 8, since a velocity of the printing sheet P conveyed by the direct transfer belt 13 also fluctuates in one rotation cycle of the driving roller 8, the conveyance velocity of the printing sheet P in the direct transfer process executed at the K-use direct transfer nip is different from that in the secondary transfer process for the Y to C toner images executed at the secondary transfer nip. As a result, the Y to K toner images sometimes deviate from each other in one rotation cycle of the driving roller 8 when transferred onto the printing sheet P.

To resolve such a problem, the below described formulas 7 to 8 are established, wherein r1 represents a radius of the driven roller 14, r2 represents a radius of the driven roller 8, x represents the distance between the K use direct transfer nip to the secondary transfer nip, y represents a distance from the Y-use primary transfer nip to the secondary transfer nip along the downstream of the intermediate transfer belt, z represents a distance between the C-use and M-use primary transfer nips or that between the M-use and Y-use primary transfer nips, and in other words that represents a station pitch between neighboring image formation units 1Y to 1C;

$$x=2\pi r2\cdot n7 \quad \text{(Formula 7)}$$

$$y=2\pi r1\cdot n8 \quad \text{(Formula 8)}$$

$$z=2\pi r1\cdot n9 \quad \text{(Formula 9)}$$

Thus, influence of the velocity fluctuation of the intermediate transfer belt 12 in a rotation cycle of the driving roller 14 to either the primary transfer process where the Y to C toner images are transferred from the photo-conductive members 11Y to 11C onto the intermediate transfer belt 12 or the secondary transfer process where the Y to C toner images are transferred from the intermediate transfer belt 12 onto the printing sheet P can be cancelled. As a result, color deviation likely caused in one rotation cycle of the driving roller 8 on the Y to C toner images transferred onto the intermediate transfer belt 12 from the photo-conductive members 11Y to 11C in the primary transfer process, or image shrinkage likely caused on the image transferred onto the printing sheet P in the secondary transfer process can be suppressed. Further, influence of a difference of velocity between the direct transfer process during when the K use toner image is directly transferred in the K use transfer nip and the secondary transfer process during when the Y to C toner images are transferred in the secondary transfer nips, specifically the velocity fluctuation of the printing sheet P in one rotation cycle of the driving roller 8, can be cancelled. Thus, color deviation of the Y to C toner images on the printing sheet P caused in one rotation cycle of the driving roller 8 due to the difference of velocity caused for the above mentioned reason can be suppressed.

Further, if the above-mentioned radius r1 and r2 can be equalized, drive rollers 8 and 14 can advantageously be the same parts maintaining the above-mentioned advantages.

Further, toner remaining and removed from the surfaces of the photo-conductive members 11Y to 11K of the printer of this embodiment can be collected by the drum cleaning devices and are used again by the developing devices of respective colors as in the conventional system.

In such a situation as shown in FIG. 5, when the K use image formation unit 1K, e.g., the K-use direct transfer nip is arranged downstream of the secondary transfer nip, the respective Y to C toner images transferred onto the printing medium P at the secondary transfer nip some times transferred again back to the photo-conductive member 11K from the printer P when the K-toner image is transferred at the direct transfer nip. Thus, when the respective Y to C toner back to the photoconductive member 11K is collected by the K use-developing device, toner mixture occurs therein. As a result, color tone deteriorates when the mixture toner develops an image formed in the image formation unit 1K.

Whereas as shown in FIG. 1 or the like, the K use image formation unit 1K, e.g., the K-use direct transfer nip is arranged up stream of the secondary transfer nip, so that the respective Y to C toner transferred onto the printing medium P at the secondary transfer nip are not transferred again back to the photo-conductive member 11K. As a result, toner does not mix in the K use developing device, and color tone of the image (i.e., a black toner image) formed in the image formation unit 1K does not change even as time elapses.

In this embodiment, the printing sheet P is carried and conveyed by the direct transfer belt 13 through the direct transfer nip and the secondary transfer nip. Thus, regardless that the direct transfer nip is arranged either downstream or up stream of the secondary transfer nip, the printing sheet P can be safely conveyed by the direct transfer belt 13 through the direct transfer nip and the secondary transfer nip. As a result, a freedom of layout in the image forming apparatus is not decreased such that the direct transfer nip should be positioned downstream of the secondary transfer nip.

Further, in this embodiment of the printer, even though the photoconductive members 11Y to 11C are positioned above the intermediate transfer belt 12, they can be arranged below the same.

Figure 7:
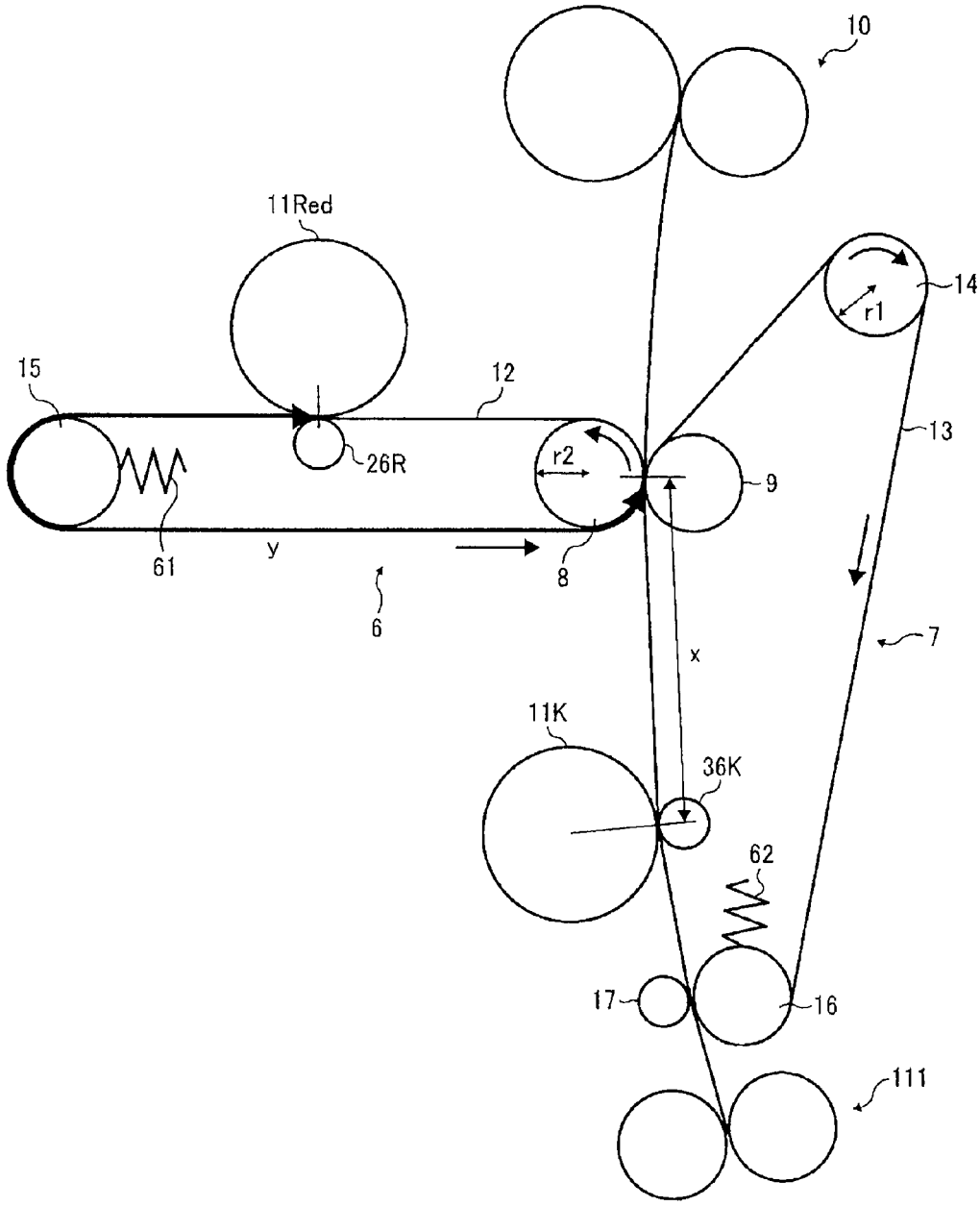
FIG. 7 schematically illustrates an exemplary transfer section when only one image formation unit opposes the intermediate transfer belt.

Further, as shown in FIG. 7, only a single image formation unit 1 (i.e., a photo-conductive member 11) storing red toner, for example, can be employed opposing to the intermediate transfer belt 12. In such a situation, since the above-mentioned station pitch z is excluded, the formulas 3 and 6 can be neglected.

Hence, by applying the above-mentioned configuration to hybrid systems of direct and indirect transfer systems, an image forming apparatus capable of obtaining a high quality image avoiding color and image deviations as well as image shrinkage can be provided.

Now, a second embodiment of a color laser printer (herein after reference to as a printer) serving as an image forming apparatus employing an electro photographic system is described with reference to FIG. 8. Then fundamental configuration of the printer of this embodiment is almost the same as that of the first embodiment.

Figure 8:
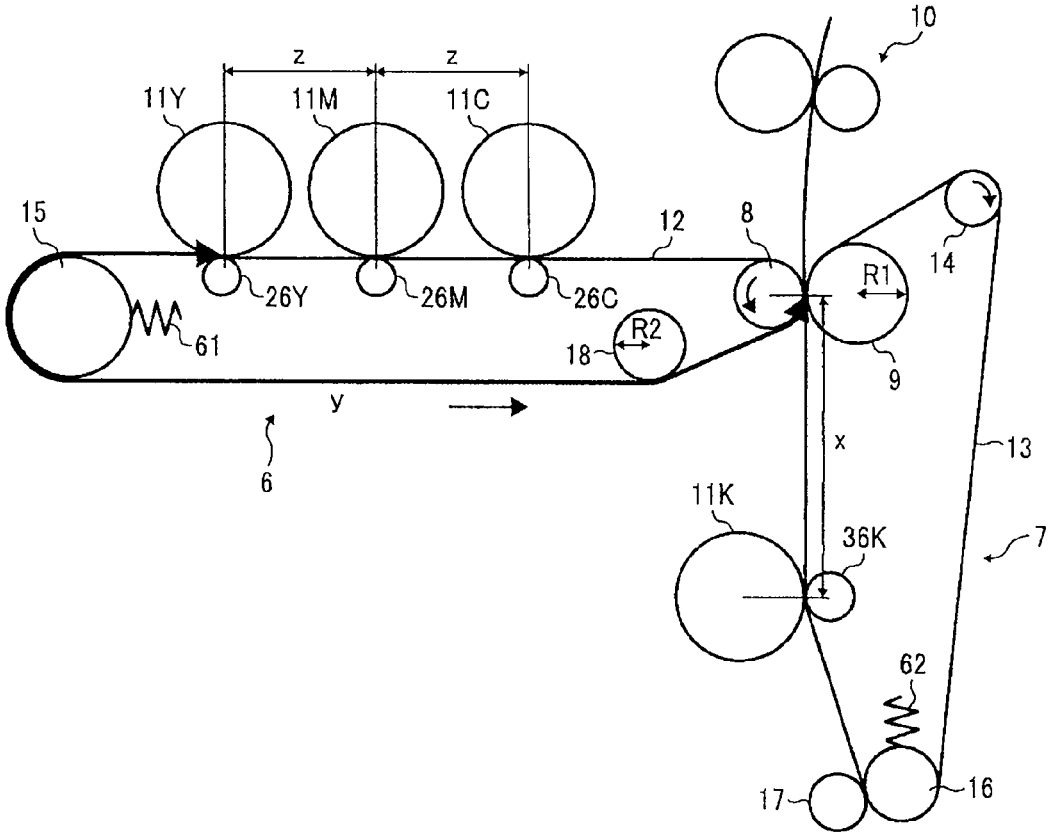
FIG. 8 illustrates an exemplary transfer section as a feature of the second embodiment of the present invention.

Specifically, as shown in FIG. 8, a direct transfer belt 13 is suspended by a secondary transfer roller 9, a driving roller 14, and a tension roller 16 or the like. The tension roller 16 is movably supported being biased by a spring from inside to outside the direct transfer belt 13, whereby providing a tension to the direct transfer belt 13. Then driving roller 14 is driven rotated by a driving motor, not shown, arranged in a printer body. The secondary transfer roller 9 and the tension roller 16 are driven rotated by the direct transfer belt 13 when the driving roller 14 rotates it. Opposing to (the secondary transfer roller 9 and) the tension roller 16 via the direct transfer belt 13, there is arranged a sheet absorption roller 17 supplied with a prescribed voltage from a power source, not shown, to stick a printing sheet P onto the direct transfer belt 13. The sheet absorption roller 17 contacts a front surface of the direct transfer belt 13 (i.e., an outer loop surface) and is driven by the direct transfer belt 13 as it rotates.

On the shaft of the secondary transfer roller 9, there is provided a rotary encoder, not shown, to detect either a rotation displacement angle or a rotation angular velocity of the secondary transfer roller 9. The rotary encoder can be provided on a shaft of another driven roller driven by the direct transfer belt 13 and the like. However, since the tension roller 16 is movably supported being biased by the spring, it readily receives load change and measurement precision of the rotary encoder deteriorates when attached to the other shafts. Thus, it is not preferable to arrange the rotary encoder on the shaft of the tension roller 16 due to unavailability of appropriate feedback control.

Figure 9:
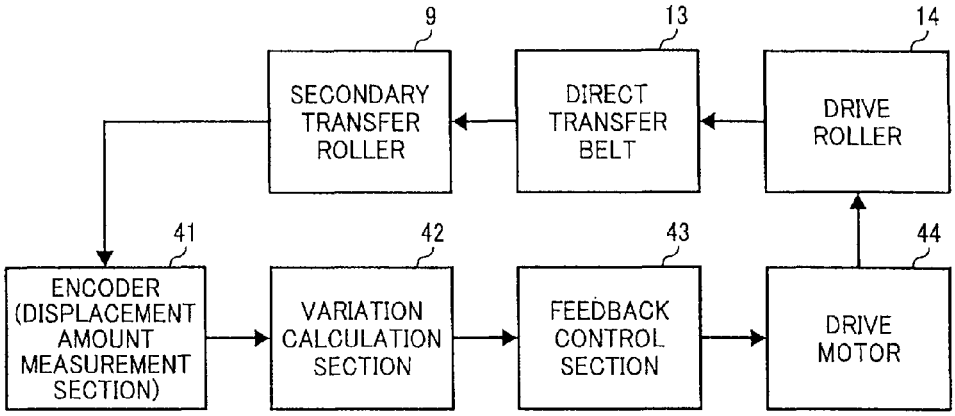
FIG. 9 illustrates an exemplary rotation drive control operation for a direct transfer unit according to one embodiment of the present invention.

Now, an exemplary rotation drive control operation for the direct transfer unit 7 is described with reference to FIG. 9. Specifically, the feedback control section 43 feeds back one of detection results of rotation angle displacement or velocity obtained based on an output from the encoder 41 to control the driving motor 44 that rotates the driving roller 14. Specifically, when the rotation angular displacement or velocity of the secondary transfer roller 9 is smaller than a prescribed control target value previously obtained through an experiment, the driving motor 44 is subjected to feedback control (acceleration control) of the feedback control section 43 in accordance with a difference between the rotation angular displacement or velocity and the prescribed control target value obtained by a difference calculation section 42 to increase the rotational velocity of the driving motor 44, and accordingly the driving roller 14. Whereas, when the rotation angular displacement or velocity of the secondary transfer roller 9 is larger than the prescribed control target value, the driving motor 44 is subjected to feedback control (deceleration control) of the feedback control section 43 in accordance with a difference between the rotation angular displacement or velocity and the prescribed control target value obtained by the difference calculation section 42 to decrease the rotational velocity of the driving motor 44, and accordingly the driving roller 14.

Thus, according to this embodiment, the feedback control of the driving roller 14 is executed to maintain a prescribed rotation angular displacement or velocity of the secondary transfer roller 9 based on the detection signal from the encoder 41 on the shaft of the secondary transfer roller 9. As a result, fluctuation of a velocity of the direct transfer belt 13 in a rotation cycle of the driving roller 14 caused by eccentricity of the driving roller 14 can be suppressed. In proportion to that, the direct transfer belt 13 driven by the driving roller 14 stably travels.

In contrast, however, the velocity fluctuation of the direct transfer belt 13 in a rotation cycle of the secondary transfer roller 9 that supports the rotary encoder or the like caused by eccentricity of the secondary transfer roller 9 cannot be suppressed by the feedback control. Specifically, (a component of) velocity fluctuation caused by the eccentricity of the driven roller, such as the secondary transfer roller 9, etc., supporting the rotary encoder, is fed back to the rotational velocity of the driving motor or that of the driving roller 14, thereby a velocity of the direct transfer belt 13 fluctuates. Thus, the conveyance velocity of the direct transfer belt 13 fluctuates in a rotation cycle of the secondary transfer roller 9 (i.e., a driven roller). Specifically, the velocity fluctuates in a cycle of $2\pi R1/V0$, wherein R1 represents a radius of the secondary transfer roller 9 (i.e., a driven roller) and V0 represents a target velocity of the direct transfer belt 13. Color deviation likely occurs between toner images of Y to K transferred onto the printing sheet P as mentioned later in a rotation cycle of the secondary transfer roller 9.

Further, the intermediate transfer belt 12 is suspended by the driving roller 8, the tension roller 15, and the driven roller 18 or the like. The tension roller 15 is movably supported by a shaft receiving a bias from a spring 61 and thus provides a tension to the intermediate transfer belt 12 from it inside to outside. The driving roller 8 is driven by a driving motor, not shown, arranged in a printer body. The tension roller 15 and the driven roller 18 or the like are driven rotated by the intermediate transfer belt 12 driven rotated by the driving roller 8.

On the shaft of the driven roller 18, there is provided a rotary encoder, not shown, to detect either a rotation angular displacement or a rotation angular velocity of the driven roller 18. The rotary encoder can be provided on one of shafts of the primary transfer rollers 26Y to 26C driven by the intermediate transfer belt 12. However, since the tension roller 15 is movably supported being biased by a spring, it readily receives a load change and precision of measurement of rotation angular displacement or velocity by the rotary encoder deteriorates than when attached thereto. Thus, it is not preferable to arrange the rotary encoder on the shaft of the tension roller 15 due to unavailability of appropriate feedback control mentioned later in detail.

Figure 10:
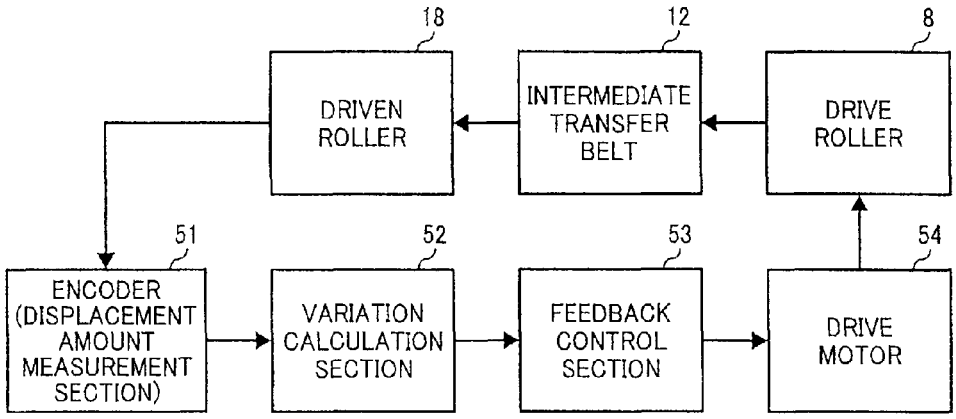
FIG. 10 illustrates an exemplary rotation drive control operation for in an intermediate transfer unit according to one embodiment of the present invention.

Now, an exemplary rotation drive control operation for the intermediate transfer unit 6 is described with reference to FIG. 10. The feedback control section 53 feeds back one of detection results of rotation angular displacement or an angular velocity obtained based on an output from the encoder 51 to control the driving motor 54 to rotate the driving roller 8. Specifically, when the rotation angular displacement or velocity of the driven roller 18 is smaller than a prescribed control target value previously obtained through an experiment, the driving motor 54 is subjected to feedback control (i.e., acceleration control) of the feedback control section 53 in accordance with a difference between the rotation angular displacement or velocity and the prescribed control target value obtained by a difference calculation section 52 to increase the rotational velocity of the driving motor 54 accordingly the driving roller 8. Whereas, when the rotation angular displacement or velocity of the driven roller 18 is larger than the prescribed control target value, the driving motor 54 is subjected to feedback control (deceleration control) of the feedback control section 53 in accordance with a difference between the rotation angular displacement or velocity and the prescribed control target value obtained by the difference calculation section 52 to decrease the rotational velocity of the driving motor 54 accordingly the driving roller 8.

Thus, according to this embodiment, the feedback control of the driving roller 8 is executed to maintain a prescribed rotation angular displacement or velocity of the driven roller 18 based on the detection signal from the encoder 51 on the shaft of the driven roller 18. As a result, fluctuation of a velocity of the intermediate transfer belt 12 in a rotation cycle of the driving roller 8 caused by eccentricity of the driven roller 8 can be suppressed. In proportion to that, the direct transfer belt 13 driven by the driving roller 14 can stably travel at a prescribed rotational velocity.

However, fluctuation of the velocity of the intermediate transfer belt 12 in a rotation cycle of the driven roller 18 caused by eccentricity of the driven roller 18 that supports the rotary encoder cannot be suppressed by the above-mentioned feedback control. Specifically, (a component of) velocity fluctuation caused by the eccentricity of the driven roller 18 is fed back to the rotational velocity of the intermediate transfer belt 12. Thus, the conveyance velocity of the intermediate transfer belt 12 fluctuates in a rotation cycle of the driven roller 18. Specifically, the velocity fluctuates in a cycle of $2\pi R2/V0$, wherein R2 represents a radius of the driving roller 18, and V0 represents a target velocity of the intermediate transfer belt 12. As a result, color deviation of images likely occurs when transferred from the photoconductive members of 11Y to 11C onto the intermediate transfer belt 12 as primary transfer in a rotation cycle of the driving roller 18.

However, the printer of this embodiment meets the following formulas 10 to 12 to resolve such a problem, wherein r1 represents a radius of a secondary transfer roller 9 supporting an rotary encoder on its shaft driven rotated by the direct transfer belt 13, r2 represents a radius of the driven roller 18 supporting an rotary encoder on its shaft driven rotated by the intermediate transfer belt 12, x represents a distance from the K-use direct transfer nip to the secondary transfer nip, y represents a distance from the Y-use primary transfer nip to the secondary transfer nip along the downstream of the intermediate transfer belt, and z represents a distance between the C-use and M-use primary transfer nips, and that between the M-use and Y-use primary transfer nips, i.e., a station pitch between neighboring image formation units 1Y to 1C, and wherein N1, N2, and N3 represent natural numbers of one, five, and one (i.e., n1=1, n2=5, and n3=1), respectively;

$$x=2\pi R1\cdot N1 \quad \text{(Formula 10)}$$

$$y=2\pi R2\cdot N2 \quad \text{(Formula 11)}$$

$$z=2\pi R2\cdot N3 \quad \text{(Formula 12)}$$

Specifically, as shown by the above-mentioned formula 12 of this embodiment of the printer, since the station pitch z is equal to a circumference (i.e., one rotation pitch) of the driven roller 18, respective primary transfer nips for Y to C uses always position at the same phase as shown in FIG. 3. Thus, color deviation of the Y to C toner images transferred onto the intermediate transfer belt 12 in the primary transfer process can be suppressed.

Further, the intermediate transfer belt 12 sequentially receiving the C to Y toner images in the respective primary transfer nips for C to Y uses is further driven rotated with its velocity fluctuating in one rotation cycle of the driven roller 18 to convey the triple color superimposed image from the Y use primary to secondary transfer nips.

Thus, if a difference of a velocity of the intermediate transfer belt 12 exists between the primary and secondary transfer nips, image shrinkage occurs on the triple color superimposed image on the printing sheet P when transferred from the intermediate transfer belt 12 in the secondary transfer nips even though image displacement does not occur.

However, according to this embodiment, as shown by formula 11, the distance y between the Y use primary to secondary transfer nips is the natural number times of the circumference of the driven roller 18 (e.g. five times). Thus, since the velocity of the intermediate transfer belt 12 fluctuates at the same phase at the Y use primary and secondary transfer nips with each other, the above-mentioned image shrinkage can be suppressed.

Further, since the printing sheet P entering the nip formed between the tension roller 16 and the sheet absorption roller 17 via the intermediate transfer belt 13 is conveyed being absorbed by the direct transfer belt 13, a conveyance velocity of the printing sheet P fluctuates in one rotation cycle of the secondary transfer roller 9 driven rotated by the direct transfer belt 13. Thus, if such fluctuation is included in the conveyance velocity of the printing sheet P, velocity in the direct transfer process for the K toner image executed at the K-use direct transfer nip sometimes becomes different from that in the secondary transfer process for Y to C toner images executed at the secondary transfer nips. Thus, color deviation likely occurs in one rotation cycle of the secondary transfer roller 9 between the Y to K toner images transferred onto the printing sheet P.

However, according to this embodiment, as represented by formula 10, the distance between the K use direct transfer nip to the secondary transfer nip is as same as the circumference of the secondary transfer roller 9 (i.e., one rotation pitch). Thus, since the phase of the velocity fluctuation of the direct transfer belt 13 at the direct transfer nip can be equalized with that of the direct transfer belt 13 at the secondary transfer nip, the conveyance velocity of the printing sheet P is the same both of when the K toner image is directly transferred at the K-use direct transfer nip and when the toner images of Y to C are transferred at the secondary transfer nips in the secondary transfer processes as shown in FIG. 4. Accordingly, color deviation in one rotation cycle of the secondary transfer roller 9 generally likely caused between the Y to K toner images on the printing sheet P can be suppressed.

The all of configurations meeting the formulas 10 to 12 has independent dynamic relations from each other in the intermediate transfer unit 6 or the direct transfer unit 7. Accordingly, even if the K use image formation unit 1K (i.e., the K use direct transfer nip) is arranged downstream of the secondary transfer nip, the above-mentioned color deviation and the image shrinkage can similarly be suppressed.

Further, toner remaining and removed from the surfaces of the photo-conductive members 11Y to 11K of the printer of this embodiment can be collected by the drum cleaning devices and are used again by the developing devices of respective colors as in the conventional system. In such a situation, for the above-mentioned reason as applied to the first embodiment, the K use image formation unit 1K, e.g., the K-use direct transfer nip is arranged upstream of the secondary transfer nip, so that the toner does not mix in the K use developing device, and color tone of the image (i.e., a K toner image) formed in the image formation unit 1K does not change even as time elapses.

Also in this embodiment, the printing sheet P is carried and conveyed by the direct transfer belt 13 through the direct transfer nip and the secondary transfer nip. Thus, regardless of that the direct transfer nip is arranged either downstream or upstream of the secondary transfer nip, the printing sheet P can be safely conveyed by the direct transfer belt 13 through the direct transfer nip and the secondary transfer nip. As a result, a freedom of layout in the image forming apparatus is not decreased such that the direct transfer nip should be positioned downstream of the secondary transfer nip.

Further, even though the photoconductive members 11Y to 11C are positioned above the intermediate transfer belt 12 in this embodiment of the printer, they can be arranged below the same.

Further, only a single image formation unit 1 (i.e., a photo-conductive member 11) can be employed opposing to the intermediate transfer belt 12. In such a situation, since the above-mentioned station pitch z is excluded, the formula 12 can be neglected.

Hence, by applying the above-mentioned configuration to hybrid direct and indirect transfer systems, an image forming apparatus capable of obtaining a high quality image while avoiding color and image deviations as well as image shrinkage can be provided.

Figure 11:
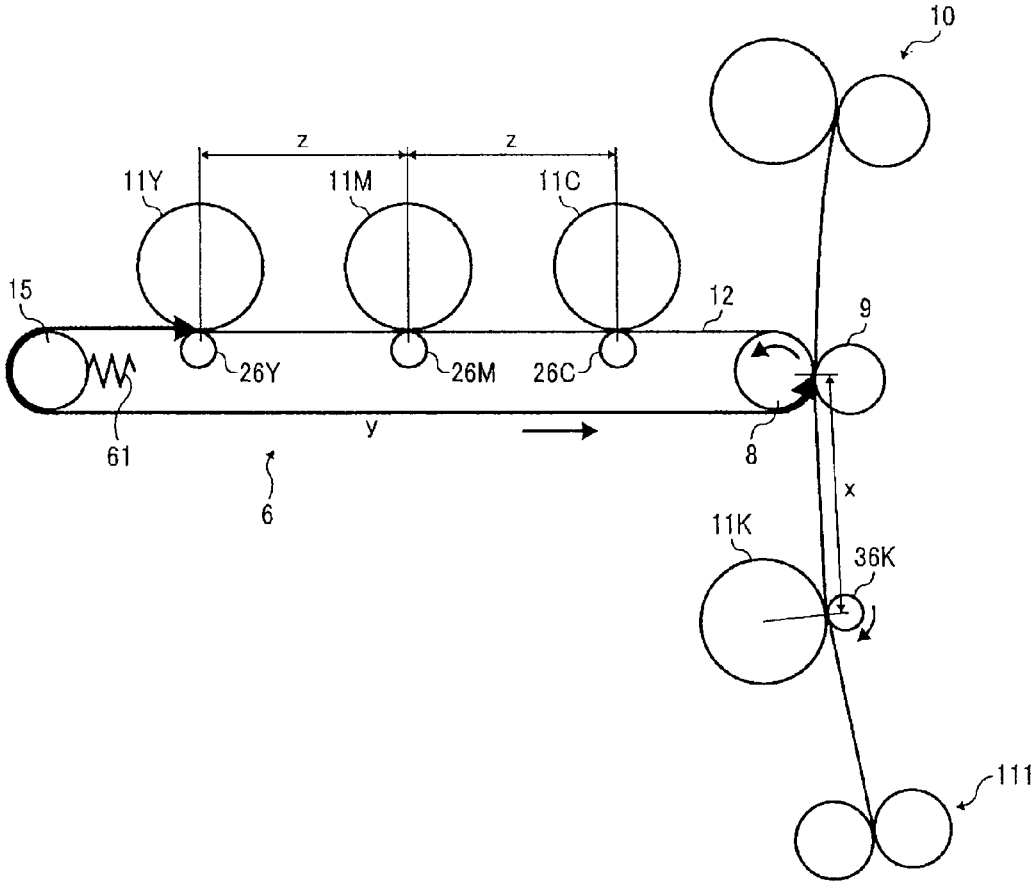
FIG. 11 illustrates an exemplary transfer section as a feature of the third embodiment of the present invention.

Now, a third embodiment of a color laser printer (herein after reference to as a printer) serving as an image forming apparatus employing an electro photographic system is described with reference to FIG. 11.

As shown, the fundamental configuration of the printer of this embodiment is almost the same as that of the first embodiment.

Specifically, different from the above-mentioned second embodiment, the printing sheet P is carried and conveyed by a photo-conductive member 11K and a transfer roller 36K driven rotated by a drive source including a drive motor, not shown, through the direct transfer nip and the secondary transfer nip while applying thereto a conveyance force via the transfer roller 36K in a printer of this embodiment.

In this system, the printing sheet P is conveyed between the secondary transfer and the direct transfer positions by a conveyance force applied from the transfer roller 36K in the direct transfer nip. Thus, the conveyance velocity of the printing sheet P fluctuates in a rotation cycle of the transfer roller 36K due to eccentricity of the transfer roller 36K. Thus, if a velocity of the printing sheet P fluctuates, and a phase thereof is different between the direct transfer and secondary transfer nips, displacement occurs on the Y to K toner images transferred onto the printing sheet between these nips in a rotation cycle of the transfer roller 36K.

However, according top this embodiment, an interval x between the direct and secondary transfer nips is natural number times of the circumference of the transfer roller 36K. Thus, the phase of the velocity fluctuation of the direct transfer belt 13 in a rotation cycle of the transfer roller 36K at the direct transfer nip can be equalized with that at the secondary transfer nip. Thus, influence of the velocity fluctuation to the conveyance velocity of the printing sheet P at these nips in a rotation cycle of the transfer roller 36K can be cancelled. As a result, color deviation caused by velocity fluctuation in one rotation cycle of the transfer roller 36K on the Y to K toner images transferred onto the printing sheet P can be suppressed.

Similar to the second embodiment, by designating the station pitch z between the neighboring image formation units 1 to be natural number of times of a circumference (i.e., one rotation pitch) of the driving roller 8, color deviation of the Y to C toner images on the intermediate transfer belt 12 in the primary transfer process can be suppressed. Because, respective primary transfer nips for Y to C always position at the same phases.

Similar to the second embodiment, by designating the distance y between the Y use primary to secondary transfer nips to be the natural number times of the circumference of the driving roller 8, the above-mentioned image shrinkage can be suppressed. Because, the velocity of the intermediate transfer belt 12 both in the Y use primary and secondary transfer nips fluctuate at the same phase with each other.

ADVANTAGE

According to one embodiment of the present invention, color deviation caused by velocity fluctuation on the Y to K toner images on the printing sheet P can be effectively suppressed.

Numerous additional modifications and variations of the present invention are possible in light of the above teachings. It is therefore to be understood that within the scope of the appended claims, the present invention may be practiced otherwise that as specifically described herein.

What is claimed is:

1. An image forming apparatus, comprising:

a first belt unit rotatably suspended by at least two first rollers;

at least one first image bearer arranged opposite a front surface of the first belt unit and configured to bear a first image;

a first image forming device configured to form the first image on the first image bearer;

a primary transfer device configured to primarily transfer the first image from the first image bearer onto the first belt unit at a primary transfer position;

a secondary transfer device configured to secondarily transfer the first image from the first belt unit onto a printing medium at a secondary transfer position;

a second image bearer configured to bear a second image other than the first image;

a second image forming device configured to form the second image on the second image bearer;

a direct transfer device configured to directly transfer the second image from the second image bearer onto the printing medium at a direct transfer position; and a second belt unit rotatably suspended by at least two second rollers and configured to carry and convey the printing medium through the direct transfer position and the secondary transfer position, and a conveyance roller rotatably contacting one of the front surface of the first belt unit and the second image bearer and configured to convey the printing medium through the direct transfer position and the secondary transfer position, wherein a size of an interval between the direct transfer position and the secondary transfer position is a multiple of a circumference of one of the at least two second rollers causing a velocity of the second belt unit and the conveyance roller to fluctuate, and the multiple is obtained by multiplying the circumference of the one of the at least two second rollers by a prescribed natural number.

2. The image forming apparatus as claimed in claim 1, wherein the below-described formula is established:

$$x=2\pi r1\cdot n1,$$

wherein x represents the interval between the direct transfer and secondary transfer positions, r1 represents a radius of one of the at least two second rollers, said one of the at least two second rollers driving and rotating the second belt unit, and n1 represents the prescribed natural number.

3. The image forming apparatus as claimed in claim 1, wherein the below-described formula is established:

$$y=2\pi r2\cdot n2,$$

wherein y represents an interval between the primary transfer position and the secondary transfer position in a first belt rotating direction, r2 represents a radius of one of the at least two first rollers driving and rotating the first belt unit, and n2 represents the prescribed natural number.

4. The image forming apparatus as claimed in claim 1, wherein the below-described formula is established;

$$z=2\pi r2\cdot n3,$$

wherein z represents an interval between neighboring two primary transfer positions of the at least two first image bearers, r2 represents a radius of one of the at least two first rollers driving and rotating the first belt unit, and n3 represents the prescribed natural number.

5. The image forming apparatus as claimed in claim 1, wherein the below-described formula is established:

$$x=2\pi r3\cdot n4,$$

wherein x represents an interval between the direct transfer position and the secondary transfer position, r3 represents a radius of one of the at least two second rollers driven rotated by the second belt unit, and n4 represent the prescribed natural number.

6. The image forming apparatus as claimed in claim 1, wherein the below described formula is established:

$$y=2\pi r4\cdot n5,$$

wherein y represents an interval between the primary transfer position and the secondary transfer position in a first belt rotating direction, r4 represents a radius of one of the at least two first rollers driven rotated by the first belt unit, and n5 represents the prescribed natural number.

7. The image forming apparatus as claimed in claim 1, wherein the below described formula is established:

$$z=2\pi r4\cdot n6,$$

wherein z represents an interval between neighboring two primary transfer positions of the at least two first image bearers, r4 represents a radius of one of the at least two first rollers driven rotated by the first belt unit, and n6 represents the prescribed natural number.

8. The image forming apparatus as claimed in claim 1, wherein the below described formula is established:

$$x=2\pi r2\cdot n7,$$

wherein x represents an interval between the direct transfer position and the secondary transfer position, r2 represents a radius of one of the at least two first rollers driving and rotating the first belt unit, and n7 represents the prescribed natural number.

9. The image forming apparatus as claimed in claim 1, wherein the below described formula is established:

$$y=2\pi r1\cdot n8,$$

wherein y represents an interval between the primary transfer position and the secondary transfer position in the first belt unit rotating direction, r1 represents a radius of one of the at least two second rollers driving and rotating the second belt unit, and n8 represents the prescribed natural number.

10. The image forming apparatus as claimed in claim 1, wherein the below described formula is established:

$$z=2\pi r1\cdot n9,$$

wherein z represents an interval between neighboring two primary transfer positions of the at least two first image bearers, r1 represents a radius of one of the at least two second rollers driving and rotating the second belt unit, and n9 represent the prescribed natural number.

11. The image forming apparatus as claimed in claim 1, wherein the below described formula is established:

$$r1=r2,$$

wherein r1 represents a radius of one of the at least two second rollers driving and rotating the second belt unit, and r2 represents a radius of one of the at least two first rollers driving and rotating the first belt unit.

12. The image forming apparatus as claimed in claim 1, further comprising:

a second belt rotation velocity detector configured to detect a rotation velocity of the second belt unit, said second belt rotation velocity detector being attached to the one of the at least two second rollers driven rotated by the second belt unit; and a feedback control device configured to apply feedback control to the one of the at least two second rollers in accordance with detection result of the second belt rotation velocity detector, said one of the at least two second rollers driving and rotating the second belt unit, wherein the below described formula is established:

$$x=2\pi R1\cdot N1,$$

wherein x represents an interval between the direct transfer position and the secondary transfer position, R1 represents a radius of one of the at least two second rollers driving and rotating the second belt unit, and N1 represents the prescribed natural number.

13. The image forming apparatus as claimed in claim 12, wherein said second belt rotation velocity detection device includes a rotary encoder attached to a rotary shaft of one of the at least two second rollers driven rotated by the second belt unit, said rotary encoder detecting one of a rotation angular velocity and a rotation angular displacement of said one of the at least two second rollers driven rotated by the second belt unit.

14. The image forming apparatus as claimed in claim 1, further comprising:

a first belt rotation velocity detector configured to detect a rotation velocity of the first belt unit, said first belt rotation velocity detector being attached to one of the at least two first rollers driven rotated by the first belt unit; and a feedback control device configured to apply feedback control to said one of the at least two first rollers driving and rotating the first belt unit in accordance with detection result of the first belt velocity detector;

wherein the below described formula is established:

$$y=2\pi R2\cdot N2,$$

wherein y represents an interval between the primary transfer position and the secondary transfer position in a first belt rotating direction, R2 represents a radius of one of the at least two first rollers driving and rotating the first belt unit, and N2 represents the prescribed natural number.

15. The image forming apparatus as claimed in claim 14, wherein the below-described formula is established;

$$Z=2\pi R2\cdot N3,$$

wherein z represents an interval between neighboring two primary transfer positions of the at least two first image bearers, R2 represents a radius of one of the at least two first rollers driving and rotating the first belt unit, and N3 represents the prescribed natural number.

16. The image forming apparatus as claimed in claim 14, wherein said first belt rotation velocity detector includes a rotary encoder configured to detect one of a rotation angular velocity and rotation angular displacement of one of the at least two first rollers driven rotated by the first belt unit, said rotary encoder being attached to a rotary shaft of the one of the at least two first rollers driven rotated by the first belt unit.

* * * * *